US008141510B2

(12) United States Patent
Ito

(10) Patent No.: US 8,141,510 B2
(45) Date of Patent: Mar. 27, 2012

(54) MARINE VESSEL STEERING DEVICE AND MARINE VESSEL INCLUDING THE SAME

(75) Inventor: Makoto Ito, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 259 days.

(21) Appl. No.: 12/637,899

(22) Filed: Dec. 15, 2009

(65) Prior Publication Data

US 2010/0154697 A1 Jun. 24, 2010

(30) Foreign Application Priority Data

Dec. 18, 2008 (JP) ..... 2008-322973

(51) Int. Cl.
*B63H 25/00* (2006.01)

(52) U.S. Cl. ..... 114/144 RE

(58) Field of Classification Search ..... 440/53, 440/58, 59, 61 S; 114/144 R, 144 RE
See application file for complete search history.

(56) References Cited

U.S. PATENT DOCUMENTS 7,156,034 B2 1/2007 Mizutani
7,828,738 B2 * 11/2010 Freiburger ..... 600/459
7,993,175 B2 * 8/2011 Hiroshima et al. ..... 440/84
2007/0089661 A1 4/2007 Yazaki et al.
2008/0026649 A1 1/2008 Ito et al.

FOREIGN PATENT DOCUMENTS

JP 2005-254850 A 9/2005
JP 2008-030608 A 2/2008

* cited by examiner

*Primary Examiner* — Daniel Venne
(74) *Attorney, Agent, or Firm* — Keating & Bennett, LLP

(57) ABSTRACT

A marine vessel steering device includes a turning mechanism arranged to be attached to a marine vessel, an operation unit arranged to be operated by an operator to steer the marine vessel, a steering angle detection unit arranged to detect a steering angle of the operation unit, a turning angle detection unit arranged to detect a turning angle of the turning mechanism, a turning control unit arranged to control the turning mechanism according to a steering angle, a phase shift determination unit arranged to determine whether phases of the steering angle and the turning angle are shifted relative to each other, and a turning control delay unit. The turning control delay unit is arranged to start control of the turning mechanism by the turning control unit after waiting for elimination of the phase shift by an operation of the operation unit when the phase shift determination unit determines that the phases of the steering angle and the turning angle are shifted relative to each other when starting the turning control unit.

12 Claims, 10 Drawing Sheets

MARINE VESSEL STEERING DEVICE AND MARINE VESSEL INCLUDING THE SAME

BACKGROUND OF THE INVENTION

1. Field of the Invention

The present invention relates to a marine vessel steering device and a marine vessel including the same.

2. Description of Related Art

An outboard motor is an example of a propulsion device for a marine vessel, and generally includes a motor and a propeller to be driven by the motor. The outboard motor is attached to the stern in a state capable of turning in the left-right direction. To control the turning angle of the outboard motor, the marine vessel is equipped with a turning mechanism. The turning mechanism turns the outboard motor according to an operation of a steering wheel performed by a steering operator.

United States Patent Application Publication No. 2007/0089661 A1 discloses an arrangement in which operations of a turning actuator are controlled by an ECU (electronic control unit) according to an output of a rotation angle sensor which detects a rotation angle of the steering wheel. In this arrangement, the steering wheel and the turning mechanism are not mechanically coupled, and the outboard motor is turned exclusively by electric control. Therefore, the steering angle of the steering wheel and the turning angle of the outboard motor may not be in phase with each other. In other words, when the steering wheel is rotated in a state in which the power supply of the system is cut off, a phase shift occurs between the steering angle and the turning angle. Therefore, in this prior art, when the internal combustion of the outboard motor is started, a phase shift between the steering angle and the turning angle is investigated. Then, in a case in which the phase shift is found, the outboard motor is automatically turned by the turning actuator so as to eliminate the phase shift when the steering wheel is operated.

SUMMARY OF THE INVENTION

The inventor of preferred embodiments of the present invention described and claimed in the present application conducted an extensive study and research regarding a marine vessel steering device, such as the one described above, and in doing so, discovered and first recognized new unique challenges and previously unrecognized possibilities for improvements as described in greater detail below.

Specifically, in the prior art of US 2007/0089661A1, when the phase shift between the steering angle and the turning angle is great, the outboard motor may be greatly automatically turned by a slight wheel operation.

In order to overcome the previously unrecognized and unsolved challenges described above, a preferred embodiment of the present invention provides a marine vessel steering device including a turning mechanism to be attached to a marine vessel, an operation unit arranged to be operated by an operator to steer the marine vessel, a steering angle detection unit arranged to detect a steering angle of the operation unit, a turning angle detection unit arranged to detect a turning angle of the turning mechanism, a turning control unit arranged to control the turning mechanism according to a steering angle detected by the steering detection unit, a phase shift determination unit arranged to determine whether phases of a steering angle detected by the steering angle detection unit and a turning angle detected by the turning angle detection unit are shifted relative to each other, and a turning control delay unit arranged to start control of the turning mechanism by the turning control unit after waiting for elimination of the phase shift by an operation of the operation unit when the phase shift determination unit determines that the phases of the steering angle and the turning angle are shifted relative to each other when starting the turning control unit.

With this arrangement, before starting control of the turning mechanism, a phase shift between the steering angle of the operation unit and the turning angle of the turning mechanism is eliminated. Accordingly, when the control of the turning mechanism is started, the control is performed such that the steering angle and the turning angle are in phase with each other, i.e., have the same phase. The phase shift can be eliminated not by actuating the turning mechanism but by an operation of the operation unit actuated by an operator.

The steering angle is a value indicating an operation angle or an operation position of the operation unit, and is a value comparable to the turning angle.

The marine vessel steering device of a preferred embodiment of the present invention further includes a notification unit which provides notification that a start of control of the turning mechanism is being delayed by the turning control delay unit.

With this arrangement, when a start of the control of the turning mechanism is being delayed for phase shift elimination, this is notified to the operator.

The notification unit may be a display unit which provides a visual notification can be detected by the eye of a steering operator or a sound production unit which provides an auditory notification that can be detected by the ear of a steering operator.

Also, the marine vessel steering device may further include an operation supporting information notification unit which notifies a steering operator of a phase shift direction or an operation direction for phase shift elimination.

Another preferred embodiment of the present invention provides a marine vessel steering device including a turning mechanism arranged to be attached to a marine vessel, a first operation unit and a second operation unit arranged to be operated by an operator for marine vessel steering, a first steering angle detection unit arranged to detect a first steering angle which is a steering angle of the first operation unit, a second steering angle detection unit arranged to detect a second steering angle which is a steering angle of the second operation unit, a turning control unit arranged to have a first controlling state in which the turning control unit controls the turning mechanism according to a first steering angle detected by the first steering angle detection unit and a second controlling state in which the turning control unit controls the turning mechanism according to a second steering angle detected by the second steering angle detection unit, a steering angle phase shift determination unit arranged to determine whether phases of the first steering angle detected by the first steering angle detection unit and the second steering angle detected by the second steering angle detection unit are shifted relative to each other, a control switching unit arranged to switch the controlling state of the turning control unit between the first controlling state and the second controlling state, and a switching delay unit arranged to enable switching of the controlling state after waiting for elimination of a phase shift by an operation of the first or second operation unit when the steering angle phase shift determination unit determines that the phase shift has occurred between the first and second steering angles when switching the controlling state by the control switching unit.

With this arrangement, the steering operator can perform a steering operation from either of the first and second operation unit. In other words, in the first controlling state, the turning control unit controls the turning mechanism according to an operation of the first operation unit, and in the second controlling state, the turning control unit controls the turning mechanism according to an operation of the second operation unit. Switching between the first and second controlling states is performed by the control switching unit. However, when phase shift occurs between the steering angles of the first and second operation units, after waiting for elimination of the phase shift by an operation of the first or second operation unit, the controlling state switching is enabled. Accordingly, consecutiveness of the steering angles can be secured, so that the operation unit can be smoothly switched.

As another measure for securing consecutiveness of steering angles, it is possible that an actuator which displaces the operation units is provided. Specifically, by actuating the actuator when switching the controlling state, the phase shift between the first and second operation units is forcibly eliminated. However, with this measure, the operation units move regardless of an operation intention of the operator. On the other hand, in an arrangement which eliminates the phase shift by an operation of the operation unit by an operator, the operation units are prevented from moving regardless of the operator's intention.

When switching the controlling state, it is normal that an operation unit corresponding to a controlling state before being switched and the turning mechanism are in phase with each other, i.e., have the same phase. Therefore, if the phase shift between the first and second operation units is eliminated by an operation of either of the operation units (generally, the operation unit corresponding to a controlling state after being switched), the operation unit corresponding to the controlling state after being switched and the turning mechanism are in phase with each other, i.e., have the same phase.

In a period in which controlling state switching is being delayed, a steering operation by the operation unit corresponding to the controlling state after being switched cannot be performed, so that in this period, propulsion force generation by a propulsion device provided on the marine vessel is preferably stopped. In detail, a controlling state switching input is accepted only when the propulsion force generation is stopped.

The control switching unit may switch the controlling state in response to an operation input of a switching operation unit operated by a steering operator. In this case, the controlling state switching unit preferably invalidates an operation input from the switching operation unit when a propulsion force is generated from the propulsion device provided in the marine vessel.

The first operation unit and the second operation unit are preferably disposed at, for example, different positions of a hull. In detail, the first and second operation units may be provided at two positions which are distant from each other such that the steering operator cannot operate these simultaneously. Accordingly, the steering operator can perform a steering operation at a plurality of positions in the marine vessel.

The marine vessel steering device preferably further includes a notification unit which provides notification that switching of the controlling state is being delayed by the switching delay unit.

With this arrangement, when switching of the controlling state is being delayed for phase shift elimination, this is notified to the operator.

The notification unit may be a display unit which provides a visual notification that can be detected by the eye of the steering operator or a sound production unit which provides an auditory notification that can be detected by the ear of the steering operator.

The marine vessel steering device may further include an operation supporting information notification unit which notifies the steering operator of a phase shift direction or an operation direction for phase shift elimination.

A preferred embodiment of the present invention provides a marine vessel including a hull, and a marine vessel steering device which is provided in the hull and has the features described above.

With this arrangement, a phase shift between the operation unit and the turning mechanism or a phase shift between the first and second operation units can be eliminated.

The marine vessel may include a propulsion device which gives a propulsion force to the hull. The propulsion device may be any of an outboard motor, an inboard/outboard motor (stern drive, inboard motor/outboard drive), an inboard motor, and a water-jet drive. The outboard motor includes a motor and a propulsion force generating member (propeller). In this case, the turning mechanism may turn the entire outboard motor horizontally with respect to the hull. The inboard/outboard motor includes a motor disposed inside the marine vessel and a drive unit including the propulsion force generating member and the turning mechanism disposed outside the marine vessel. The inboard motor preferably has a form in which a motor and a drive unit are installed inside the hull and a propeller shaft extends to the outside of the marine vessel from the drive unit. In this case, the turning mechanism is preferably provided separately. The water-jet drive obtains a propulsion force by accelerating water suctioned from the bottom with a pump and jetting the water from an injection nozzle on the stern. In this case, the turning mechanism preferably includes the injection nozzle and a mechanism which turns the injection nozzle along a horizontal plane.

As an operation unit for a steering operation, a (for example, wheel-shaped) steering mechanism, a lever, and a pedal may be used by way of example.

Other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
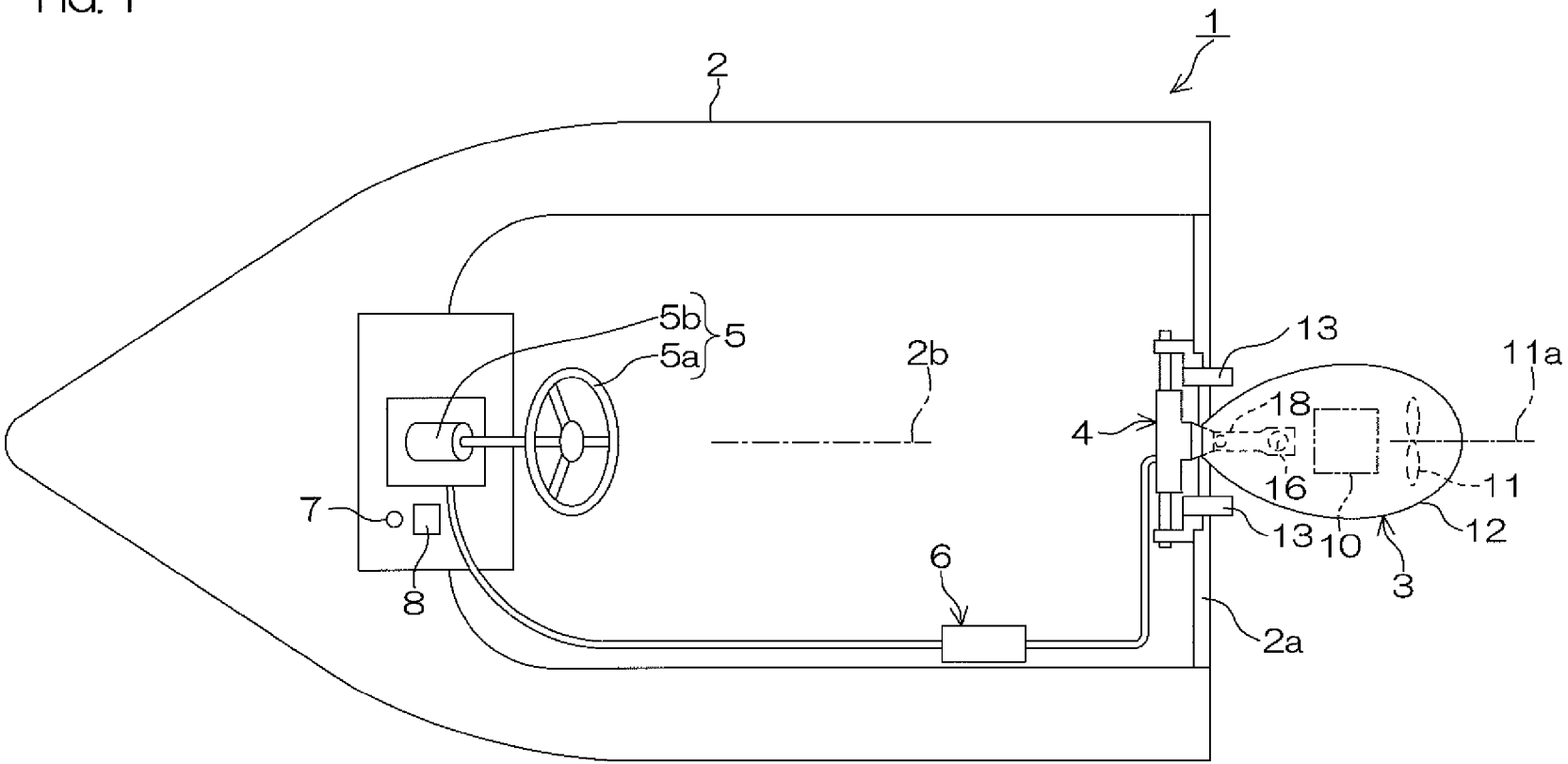
FIG. 1 is an illustrative plan view for describing an arrangement of a marine vessel of a first preferred embodiment of the present invention.

FIG. 1 is an illustrative plan view for describing an arrangement of a marine vessel of a first preferred embodiment of the present invention. The marine vessel 1 includes a hull 2, an outboard motor 3, a turning mechanism 4, an operation section 5, and a controller 6.

The outboard motor 3 is attached to a transom 2*a* of the hull 2, and is swingable (turnable) in the left-right direction. The outboard motor 3 includes an engine (internal combustion) 10 as a motor, and a propeller 11 to be driven to rotate by the engine 10. An upper portion of the outboard motor 3 accommodating the engine 10 is protected by a top cowling or engine cover 12. The turning mechanism 4 causes the outboard motor 3 to swing (turn) to the left and the right.

The operation section 5 includes a steering mechanism 5*a*, such as a wheel or handle, as an operation unit arranged to be operated by an operator, and a steering angle sensor 5*b* arranged to detect a steering angle (operation angle) of the steering mechanism 5*a*. An output signal of the steering angle sensor 5*b* is input into the controller 6.

The controller 6 preferably is an electronic control unit (ECU), and includes a microcomputer. The controller 6 controls operations of the turning mechanism 4 according to a steering angle detected by the steering angle sensor 5*b*. The controller 6 also has a function of controlling an output of the engine 10 although the control system is not shown.

An indicator 7 and a display 8 are disposed on a steering station at which the operation section 5 is disposed. The indicator 7 includes, for example, an indicator lamp (such as an LED lamp, for example), and is arranged to display whether steering by the steering mechanism 5*a* is reflected in turning of the outboard motor 3 (active state/inactive state). The display 8 is arranged to display a phase shift direction or an operation direction for eliminating the phase shift when the phase shift occurs between the steering mechanism 5*a* and a turning angle of the outboard motor 3.

Figure 2:
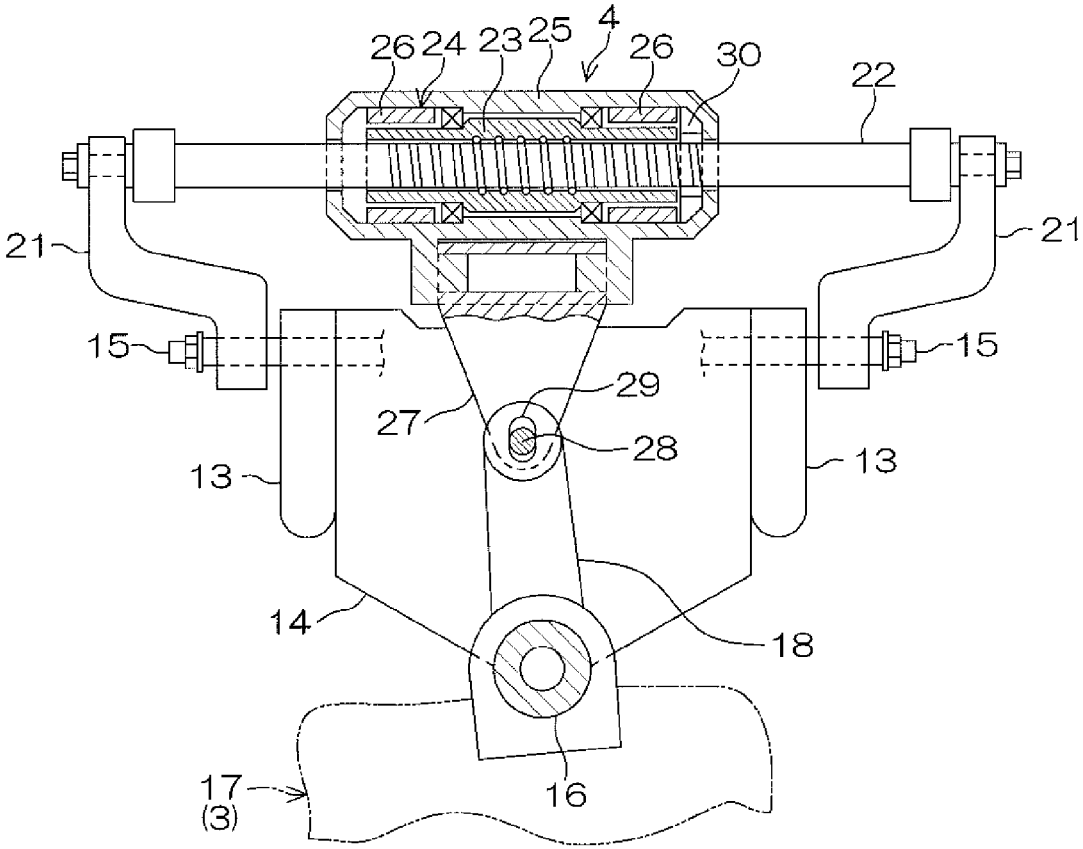
FIG. 2 is a sectional plan view for describing an arrangement of a turning mechanism.

FIG. 2 is a sectional plan view for describing an arrangement of the turning mechanism 4. The outboard motor 3 is attached to the transom 2*a* (see FIG. 1) of the hull 2 via a clamp bracket 13 and a swivel bracket 14. In detail, the clamp bracket 13 is fixed to the transom 2*a*, and the swivel bracket 14 is coupled to the clamp bracket 13. Further, to the swivel bracket 14, the outboard motor 3 is attached swingably (turnably) in the left-right direction. In greater detail, the clamp bracket 13 supports the swivel bracket 14 turnably in the up-down direction via a tilt shaft 15 extending in the left-right direction. The swivel bracket 14 has a steering shaft 16 erected on the rear end of the swivel bracket. On this steering shaft 16, a main body 17 of the outboard motor 3 is supported turnably in the left-right direction.

The outboard motor main body 17 is provided with a steering bracket 18 extending and projecting to the forward side of the steering shaft 16. By swinging this steering bracket 18 around the steering shaft 16, the outboard motor 3 can be turned to the left and right with respect to the swivel bracket 14.

The turning mechanism 4 includes a pair of left and right support members 21, a ball screw shaft 22, a ball screw nut 23, and a turning motor 24. The pair of support members 21 are supported on the clamp bracket 13 turnably via the tilt shaft 15. The ball screw shaft 22 is laid across these support members 21. The ball screw nut 23 is screwed on the ball screw shaft 22. The turning motor 24 rotates the ball screw nut 23 around the ball screw shaft 22, and includes a housing 25 which houses the ball screw nut 23.

The ball screw shaft 22 is supported on the support members 21 such that its axis line extends along the left-right direction of the hull 2. The ball screw nut 23 is supported rotatably inside the housing 25, and is restricted from moving, with respect to the housing 25, in the axial direction of the housing 25 (parallel or substantially parallel to the axial direction of the ball screw shaft 22).

The turning motor 24 includes a stator 26 fixed inside the housing 25, and by energizing a coil (not shown) of this stator 26, the ball screw nut 23 as a rotor is driven to rotate. The rotation of the turning motor 24 is controlled by a controller 6. Inside the housing 25, a turning angle sensor 30 arranged to detect a turning angle of the outboard motor 3 by detecting the rotation of the ball screw nut 23 is provided. The turning angle sensor 30 may, for example, include a gap sensor arranged to detect a number of grooves (ridges) formed on the outer peripheral surface of the ball screw nut 23 based on magnetic flux changes. The turning angle of the outboard motor 3 is an angle of a propeller center line 11*a* of the outboard motor 3 with respect to a center line 2*b* of the hull 2, and may be referred to as "turning angle of the turning mechanism 4" hereinafter. The center line 2*b* is a straight line passing through the bow and the stern center.

The housing 25 includes a turning arm 27 extending rearward to the outboard motor 3. On the rear end of the turning arm 27, a joint pin 28 is erected. A slot 29 formed in the tip end of the steering bracket 18 is freely fitted around the joint pin 28. Accordingly, the steering bracket 18 is joined to the turning arm 27 turnably.

With this arrangement, when the ball screw nut 23 is rotated by the turning motor 24, the ball screw nut 23 moves in the left-right direction along the ball screw shaft 22. Accordingly, the housing 25 is caused to move in the left-right direction, and the steering bracket 18 coupled to the turning arm 27 swings around the steering shaft 16. As a result, the outboard motor 3 coupled to the steering bracket 18 is turned.

Figure 3:
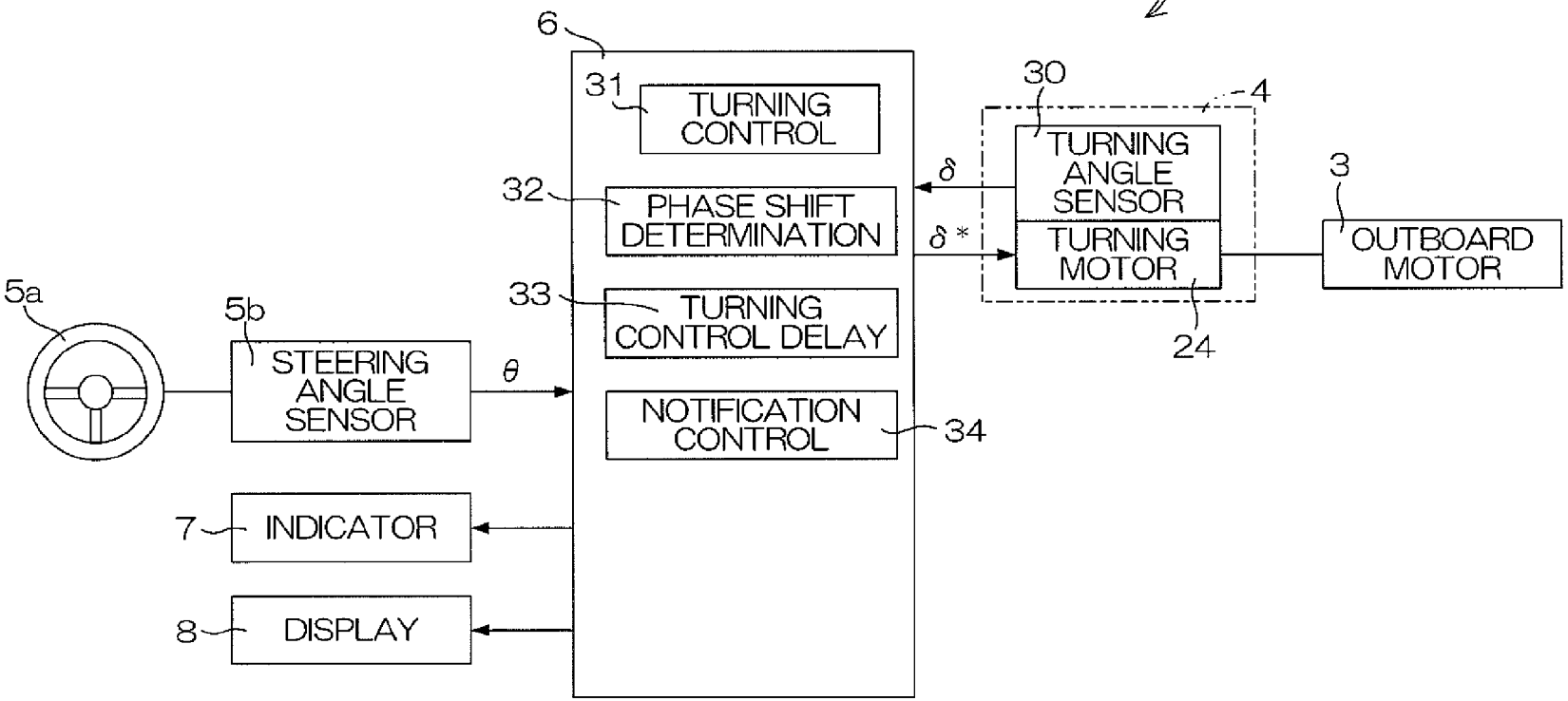
FIG. 3 is a block diagram for describing an electric arrangement concerning turning control of the marine vessel of the first preferred embodiment of the present invention.

FIG. 3 is a block diagram for describing an electric arrangement concerning turning control of the marine vessel. Output signals of the steering angle sensor 5*b* and the turning angle sensor 30 are input to the controller 6. Based on these signals, the controller 6 controls the turning motor 24 provided in the turning mechanism 4. Also, the controller 6 controls the indicator 7 and the display 8.

The controller 6 includes a CPU and a memory, and realizes functions as a plurality of function processing units by executing a predetermined program or programs. In detail, the controller 6 performs functions as a turning control unit 31, a phase shift determination unit 32, a turning control delay unit 33, and a notification control unit 34.

The function as the turning control unit 31 is to set a target turning angle $\delta^*$ of the outboard motor 3 according to a steering angle $\theta$ detected by the steering angle sensor 5*b* and control the turning motor 24 so as to attain the target turning angle $\delta^*$. In other words, the controller 6 feed-back controls the turning motor 24 such that the turning angle $\delta$ detected by the turning angle sensor 30 becomes equal to the target turning angle $\delta^*$.

The function as the phase shift determination unit 32 is to determine whether a phase shift occurs between the steering angle $\theta$ of the steering mechanism 5*a* and the turning angle $\delta$ of the turning mechanism 4 before turning control by the turning control unit 31 is started when starting the controller 6. In detail, the phase shift determination unit 32 compares a target turning angle δ* corresponding to the steering angle θ detected by the steering angle sensor 5*b* and a turning angle δ detected by the turning angle sensor 30, and determines whether the difference |δ*−δ| between these angles is not more than a predetermined threshold ϵ (≧0).

The function as the turning control delay unit 33 is to delay the start of turning control to be performed by the turning control unit 31 when the phase shift determination unit 32 determines that phase shift has occurred. In detail, the controller 6 delays the start of the turning control until the phase shift determination unit 32 determines that no phase shift occurs as a result of an operation of the steering mechanism 5*a* by a steering operator.

The function as the notification control unit 34 includes a function of displaying that the start of turning control is being delayed by the turning control delay unit 33 on the indicator 7. Further, the function as the notification control unit 34 includes a function of displaying a direction of phase shift between the steering angle θ of the steering mechanism 5*a* and the turning angle δ of the turning mechanism 4 and a direction in which the steering mechanism 5*a* should be operated for eliminating the phase shift, on the display 8.

Figure 4:
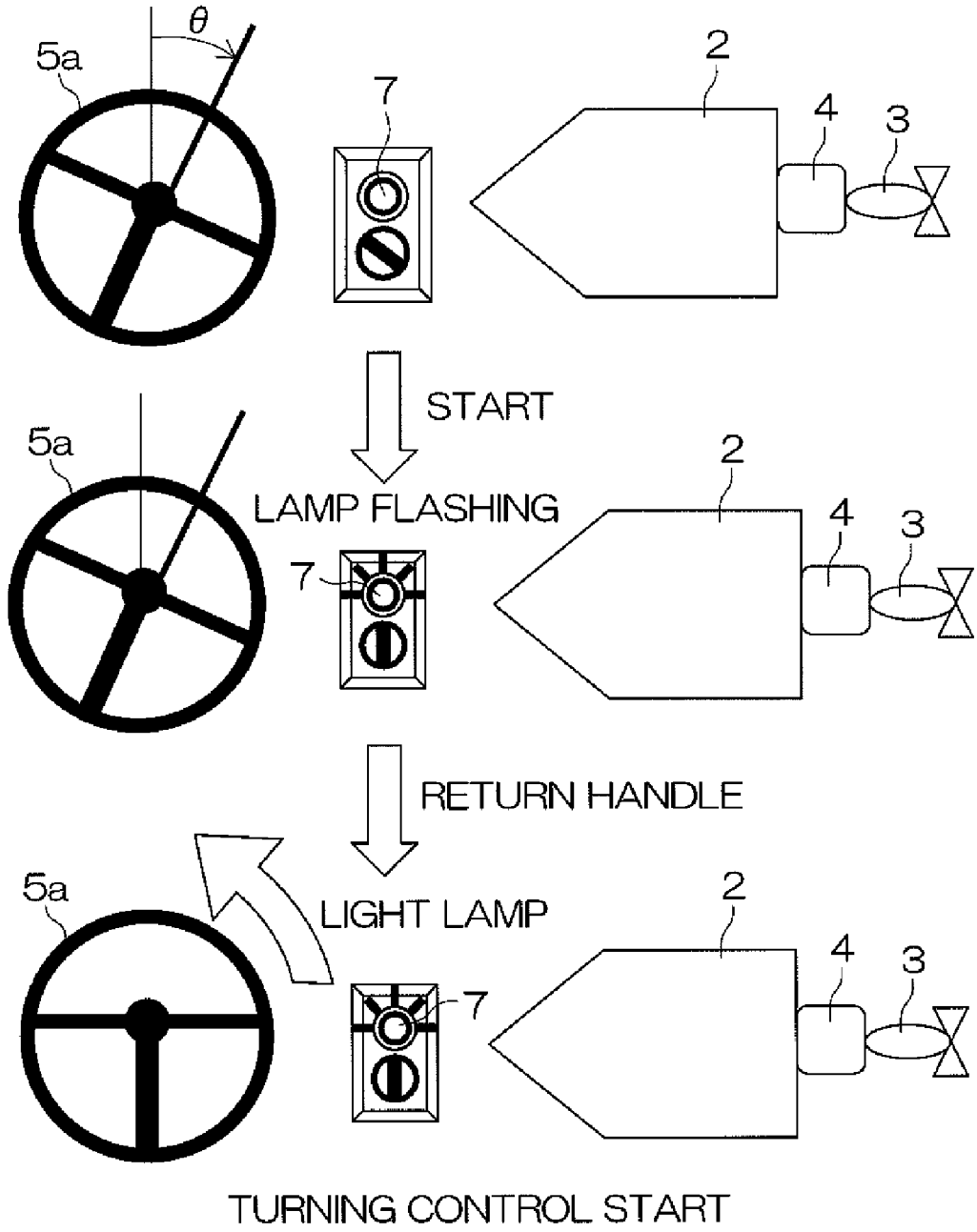
FIG. 4 is an explanatory view illustrating characteristic operations in the first preferred embodiment of the present invention.

FIG. 4 is an explanatory view illustrating characteristic operations in the present preferred embodiment. When the power supply of the controller 6 is cut off, even if the steering mechanism 5*a* is rotated, the turning mechanism 4 does not operate. Therefore, deviation (phase shift) occurs in correspondence between the steering angle θ of the steering mechanism 5*a* and the turning angle δ of the turning mechanism 4. For example, even when the turning mechanism 4 is at a neutral position and the turning angle δ=0, the steering mechanism 5*a* may deviate from the neutral position and the steering angle may become θ≠0. The steering angle range of the steering mechanism 5*a* is, for example, mechanically limited. The detailed steering angle range is, for example, about 1260 degrees to each of the left and the right. Therefore, if the phase shift occurs, either left or right steering angle range and turning angle range may become narrower than normal.

Therefore, in the present preferred embodiment, when the controller 6 is started, it is determined whether a phase shift has occurred. When a phase shift has occurred, the controller 6 delays the start of control (turning control) of the turning mechanism 4 according to the steering angle θ. In detail, the controller 6 delays the start of turning control until the phase shift between the steering angle θ and the turning angle δ is eliminated by an operation of the steering mechanism 5*a* by a steering operator. When the phase shift is eliminated, the controller 6 starts turning control. In other words, the outboard motor 3 is turned according to a turning operation of the steering mechanism 5*a*.

For example, the controller 6 flashes the indicator 7 if phase shift occurs when starting. Accordingly, a steering operator is notified of turning control being delayed due to a phase shift. The controller 6 displays information on a direction of the phase shift on the display 8 although this is not shown. This information may be the direction of the phase shift. In this case, a steering operator can eliminate the phase shift by rotating the steering mechanism 5*a* in a direction opposite to the displayed direction. Also, the information may be a direction in which the steering mechanism 5*a* should be operated for eliminating the phase shift. In this case, the steering operator can eliminate the phase shift by rotating the steering mechanism 5*a* in the displayed direction.

When the phase shift between the steering angle θ of the steering mechanism 5*a* and the turning angle δ of the turning mechanism is eliminated, the controller 6 switches the indication state of the indicator 7 from flashing indication to continuous lighting indication. Accordingly, the steering operator is notified that turning control is enabled, that is, it becomes possible to turn the outboard motor 3 by an operation of the steering mechanism 5*a*.

Figure 5:
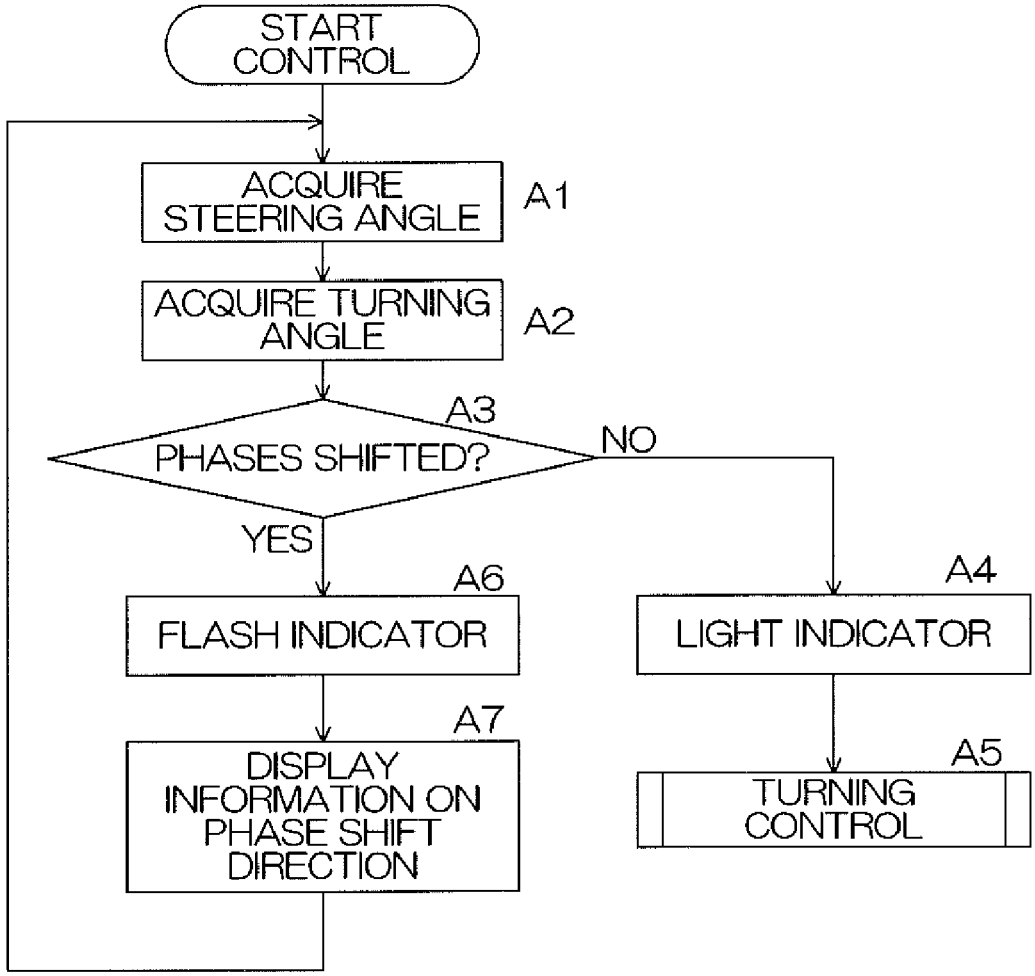
FIG. 5 is a flowchart for describing an operation example when starting.

FIG. 5 is a flowchart for describing an operation example when starting the controller 6. The start of the controller 6 includes restart of the controller 6 for some reason (for example, restoring from control abnormality) as well as turning-on of the power supply.

When starting, the controller 6 acquires a steering angle θ detected by the steering angle sensor 5*b* and a turning angle δ detected by the turning angle sensor 30 (Steps A1 and A2). The controller 6 determines whether phase shift has occurred between the acquired steering angle θ and the turning angle δ (Step A3: function as the phase shift determination unit 32). For example, the controller 6 obtains a target turning angle δ* corresponding to the steering angle θ and determines whether the difference |δ*−δ| between the target turning angle δ* and an actual turning angle δ is not more than a predetermined threshold ϵ (≧0). Specifically, the controller 6 determines that a phase shift has not occurred when the difference |δ*−δ| is not more than the threshold ϵ (for example, 3 degrees), and otherwise, determines that a phase shift has occurred.

When phase shift does not occur (Step A3: NO), the controller 6 lights (e.g., continuously lights) the indicator 7 to notify the steering operator that the turning control is enabled (Step A4). Then, the controller 6 starts turning control (Step A5: function as the turning control unit 31).

On the other hand, when phase shift occurs (Step A3: YES), the controller 6 does not start but delays the turning control (function as the turning control delay unit 33), and drives and flashes the indicator 7 to notify the steering operator that the start of the turning control is being delayed (Step A6: function as the notification control unit 34). Further, the controller 6 displays information showing a direction of the phase shift on the display 8 (Step A7: function as the notification control unit 34). Thereafter, the process of the controller 6 returns to Step A1.

For example, the controller 6 may obtain a deviation Δ=δ*−δ of the target turning angle δ* with respect to the actual turning angle δ and may display a rightward or leftward arrow on the display 8 according to the sign of the deviation Δ. For example, it is assumed that a positive sign is assigned to rightward steering angle θ, turning angle δ, and target turning angle δ*, and that a negative sign is assigned to leftward steering angle θ, turning angle δ, and target turning angle δ*. When the deviation Δ is positive, the rotation position of the steering mechanism 5*a* deflects to the right side with respect to the turning angle δ of the turning mechanism 4. On the contrary, when the deviation Δ is negative, the rotation position of the steering mechanism 5*a* deflects to the left side with respect to the turning angle δ of the turning mechanism 4. Therefore, the controller 6 may display a rightward arrow on the display 8 when the deviation Δ is positive, and display a leftward arrow on the display 8 when the deviation Δ is negative. Accordingly, on the display 8, a direction of phase shift is displayed, so that the steering operator recognizes that the steering mechanism 5*a* should be rotated in a direction opposite to the displayed arrow for eliminating the phase shift. Also, the controller 6 may display a leftward arrow on the display 8 when the deviation Δ is positive, and display a rightward arrow on the display 8 when the deviation Δ is negative. Accordingly, on the display 8, a direction in which the steering mechanism 5*a* should be operated for eliminating the phase shift is displayed. Therefore, the steering operator is to rotate the steering mechanism 5*a* in the displayed direction.

Thus, according to the present preferred embodiment, when phase shift occurs when starting the controller 6, turning control is delayed until the phase shift is eliminated by an operation of the steering mechanism 5*a*. Accordingly, the turning control can be performed in a state in which the phase shift is eliminated. Also, a turning operation which has no relation to the steering operator's intention is not performed, thereby providing an improved experience for the steering operator. Further, in the present preferred embodiment, the indicator 7 notifies the steering operator that turning control is being delayed due to phase shift, so that the operator is informed of the delay to improve the experience for the operator. Further, information on the direction of the phase shift is displayed on the display 8, so that the operator can perform an operation of the steering mechanism 5*a* for eliminating the phase shift without fail. Accordingly, the phase shift can be eliminated quickly to enable turning of the outboard motor 3.

Figure 6:
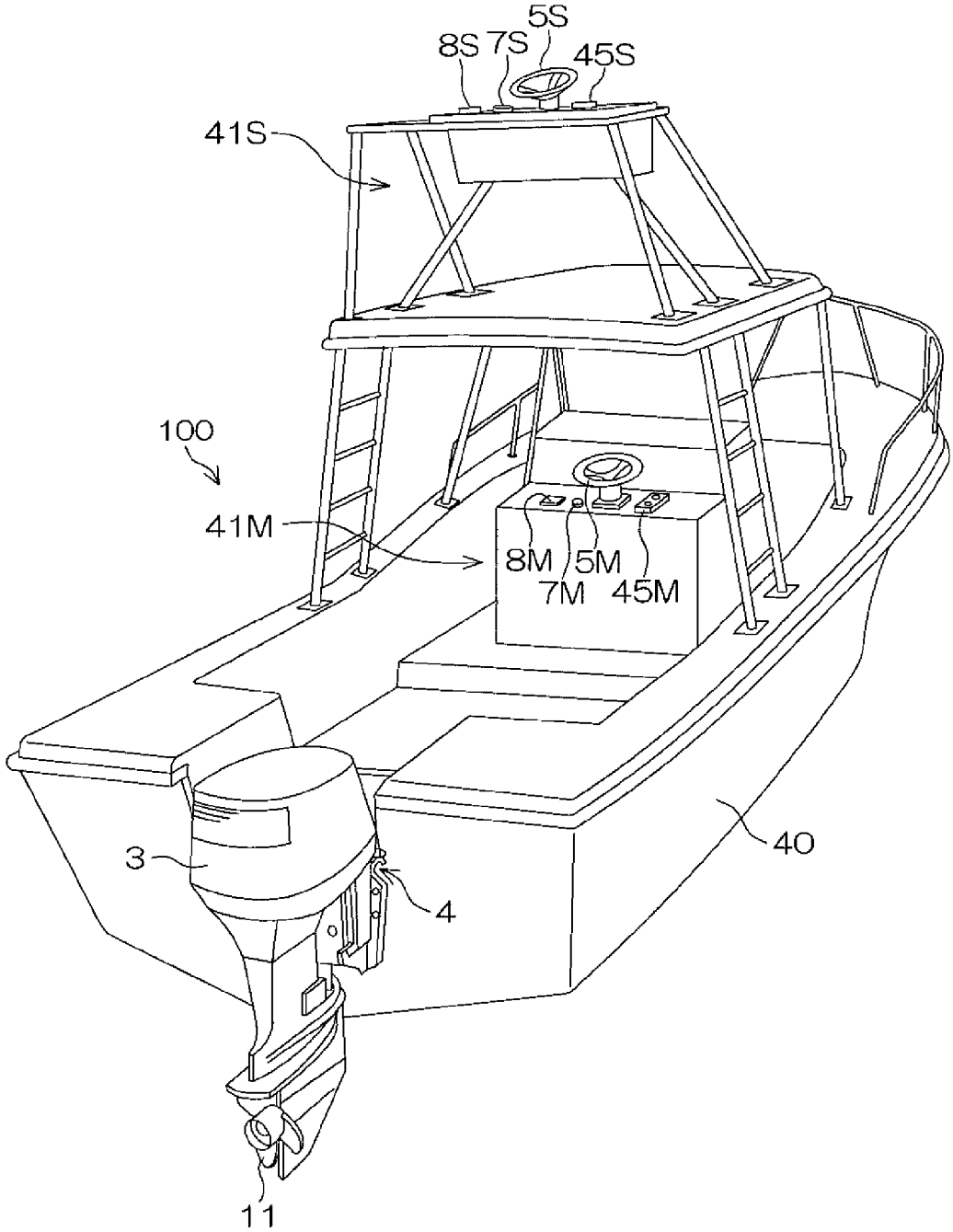
FIG. 6 is a perspective view for describing an arrangement of a marine vessel of a second preferred embodiment of the present invention.

FIG. 6 is a perspective view for describing an arrangement of a marine vessel of a second preferred embodiment of the present invention. In this FIG. 6, components corresponding to the components shown in FIG. 1 described above will be designated with the same reference symbols.

This marine vessel 100 includes a hull 40, an outboard motor 3, and a turning mechanism 4. The outboard motor 3 is attached to the rear (stern) of the hull 40, and the attaching structure is the same as in the first preferred embodiment. The structure of the turning mechanism 4 is also the same as in the first preferred embodiment.

The hull 40 includes two steering stations 41M and 41S. In detail, the main station 41M is disposed at the center of the hull 40, and the sub station 41S is disposed above the main station 41M. A steering operator can perform operations for steering in either of these steering stations 41M and 41S.

In the main station 41M, a main steering mechanism 5M, a main indicator 7M, a main display 8M, and a main key switch device 45M are disposed. Similarly, in the sub station 41S, a sub steering mechanism 5S, a sub indicator 7S, a sub display 8S, and a sub key switch device 45S are disposed.

Figure 7:
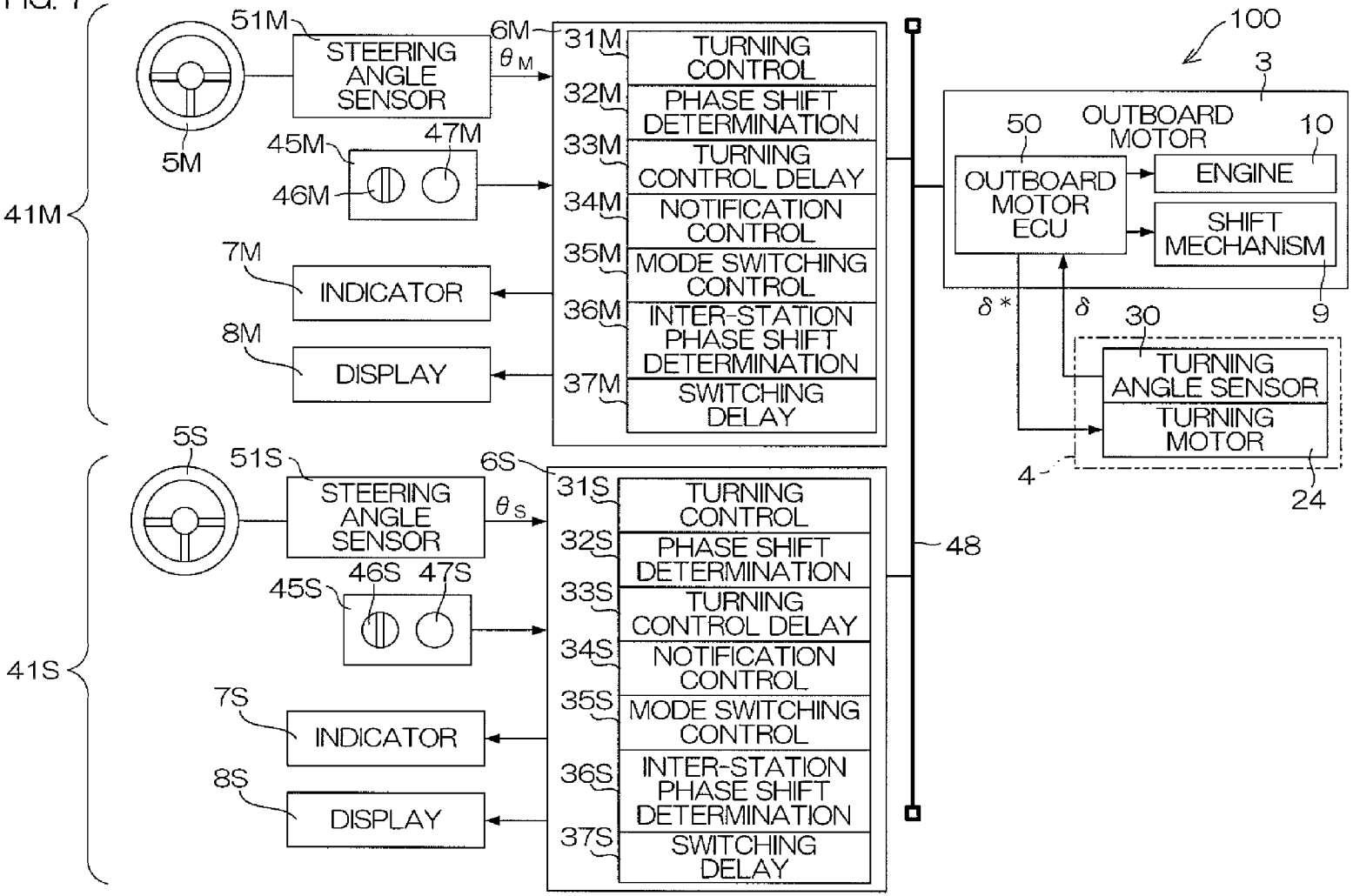
FIG. 7 is a block diagram for describing an electric arrangement of the marine vessel of the second preferred embodiment of the present invention.

FIG. 7 is a block diagram for describing an electric arrangement of the marine vessel 100. A main controller 6M is provided corresponding to the main station 41M, and a sub controller 6S is provided corresponding to the sub station 41S. To the main steering mechanism 5M, a main steering angle sensor 51M which is arranged to detect a steering angle (operation angle) $\theta_M$ of the main steering mechanism 5M is attached. An output signal of the main steering angle sensor 51M is input into the main controller 6M. Similarly, to the sub steering mechanism 5S, a sub steering angle sensor 51S which is arranged to detect a steering angle (operation angle) $\theta_S$ of the sub steering mechanism 5S is attached. An output signal of the sub steering angle sensor 51S is input into the sub controller 6S.

The outboard motor 3 is provided with a shift mechanism 9, an engine 10, and an outboard motor ECU (electronic control unit) 50 for controlling these. A turning motor 24 and a turning angle sensor 30 are connected to the outboard motor ECU 50.

The shift mechanism 9 is controlled to any of the shift positions including the forward drive position, the reverse drive position, and the neutral position by the outboard motor ECU 50. The forward drive position is a shift position at which a driving force of the engine 10 is transmitted to the propeller 11 so as to rotate the propeller 11 in a rotational direction of generating a propulsion force in the forward drive direction. The reverse drive position is a shift position at which the driving force of the engine 10 is transmitted to the propeller 11 so as to rotate the propeller 11 in a rotational direction of generating a propulsion force in the reverse drive direction. The neutral position is a shift position at which the driving force of the engine 10 is not transmitted to the propeller 11. Therefore, by controlling the shift position of the shift mechanism 9 to the neutral position, propulsion force generation can be stopped. Also, the outboard motor ECU 50 can control the rotational speed of the engine 10 by controlling a throttle opening of the engine 10.

The outboard motor ECU 50, the main controller 6M, and the sub controller 6S can exchange information with each other via a communication line 48. The communication line 48 may have a form of an inboard LAN (local area network), for example. The main controller 6M and the sub controller 6S acquire a turning angle δ detected by the turning angle sensor 30 via the communication line 48 from the outboard motor ECU 50. Also, the controllers 6M and 6S supply control commands concerning turning control of the turning mechanism 4 and output control of the engine 10 to the outboard motor ECU 50 via the communication line 48. According to the control commands, the outboard motor ECU 50 controls the turning motor 24 and the engine 10. Accordingly, the controllers 6M and 6S indirectly perform turning control for controlling the turning motor 24. The main controller 6M and the sub controller 6S can exchange information with each other via the communication line 48, and either one of the controllers controls the outputs of the turning motor 24 and the engine 10.

Further, the main controller 6M controls the main indicator 7M and the main display 8M. Similarly, the sub controller 6S controls the sub indicator 7S and the sub display 8S.

The main key switch device 45M is connected to the main controller 6M, and the sub key switch device 45S is connected to the sub controller 6S. The main key switch device 45M includes a start/stop switch 46M and a station changeover switch 47M. Similarly, the sub key switch device 45S includes a start/stop switch 46S and a station changeover switch 47S.

The start/stop switches 46M and 46S are key switches to be operated for turning on/off the entire system including the controller 6M, the controller 6S, and the outboard motor 3, and for starting/stopping the engine 10.

The station changeover switch 47M is a switch for setting control modes of the controllers 6M and 6S to a main station mode. The main station mode is a control mode in which an operation input from the main station 41M is validated and an operation input from the sub station 41S is invalidated. Similarly, the station changeover switch 47S is a switch for setting control modes of the controllers 6M and 6S to a sub station mode. The sub station mode is a control mode in which an operation input from the sub station 41S is validated and an operation input from the main station 41M is invalidated.

Each of the controllers 6M and 6S preferably includes a CPU and a memory, and by performing a predetermined program, realizes functions as a plurality of function processing units. In detail, the main controller 6M performs functions as a turning control unit 31M, a phase shift determination unit 32M, a turning control delay unit 33M, a notification control unit 34M, a mode switching control unit 35M, an inter-station phase shift determination unit 36M, and a switching delay unit 37M. Similarly, the sub controller 6S performs functions as a turning control unit 31S, a phase shift determination unit 32S, a turning control delay unit 33S, a notification control unit 34S, a mode switching control unit 35S, an inter-station phase shift determination unit 36S, and a switching delay unit 37S.

The function as the turning control unit 31M or 31S is to set a target turning angle δ* of the outboard motor 3 according to a steering angle $\theta_M$ or $\theta_S$ detected by the steering angle sensor 51M or 51S. This target turning angle δ* is given to the outboard motor ECU 50. The outboard motor ECU 50 feedback controls the turning motor 24 such that the turning angle δ detected by the turning angle sensor 30 becomes equal to the target turning angle δ*.

The function as the phase shift determination unit 32M or 32S is to determine whether a phase shift has occurred between a steering angle $\theta_M$ or $\theta_S$ of the steering mechanism 5M or 5S and the turning angle δ of the turning mechanism 4 before turning control by the turning control unit 31M or 31S is started when starting the controller 6M or 6S. In detail, the phase shift determination unit 32M and 32S compares a target turning angle δ* corresponding to a steering angle $\theta_M$ or $\theta_S$ detected by the steering angle sensor 51M or 51S and a turning angle δ detected by the turning angle sensor 30, and determines whether a difference $|\delta^*-\delta|$ between these is not more than a predetermined threshold $\epsilon$ ($\geqq 0$).

The function as the turning control delay unit 33M or 33S is to delay the start of turning control to be performed by the turning control unit 31M or 31S when the phase shift determination unit 32M or 32S determines that phase shift has occurred. In detail, the turning control delay unit 33M or 33S delays the start of turning control until the phase shift determination unit 32M or 31S determines that no phase shift has occurred as a result of an operation of the steering mechanism 5M or 5S by a steering operator.

The function as the mode switching control unit 35M or 35S is to set the control mode of the controller 6M or 6S to the main station mode or the sub station mode. When the control mode of the main controller 6M is set to the main station mode, the turning control unit 31M of the main controller 6M performs drive control of the turning mechanism 4 according to a steering angle $\theta_M$ detected by the main steering angle sensor 51M. Also, when the control mode of the main controller 6M is set to the sub station mode, the turning control unit 31M does not respond to a detection result of the main steering angle sensor 51M, and therefore, it does not perform turning control. On the other hand, when the control mode of the sub controller 6S is set to the sub station mode, the turning control unit 31S of the sub controller 6S performs drive control of the turning mechanism 4 according to a steering angle $\theta_S$ detected by the sub steering angle sensor 51S. Also, when the control mode of the sub controller 6S is set to the main station mode, the turning control unit 31S of the sub controller 6S does not respond to a detection result of the sub steering angle sensor 51S, and therefore, does not perform turning control.

The mode switching control unit 35M of the main controller 6M preferably permits switching from the sub station mode to the main station mode on the condition that the outboard motor 3 does not generate a propulsion force. In other words, the mode switching control unit 35M performs control mode switching only when the shift position of the shift mechanism 9 is at the neutral position. The control mode switching is performed in response to an operation on the station changeover switch 47M. Therefore, an operation input from the station changeover switch 47M is validated only when the shift position of the shift mechanism 9 is at the neutral position. The mode changeover control unit 35M invalidates an operation input of the station changeover switch 47M when the shift position is at the forward drive position or the reverse drive position.

Similarly, the mode switching control unit 35S of the sub controller 6S preferably permits switching from the main station mode to the sub station mode on the condition that the outboard motor 3 does not generate a propulsion force. In other words, the mode switching control unit 35S performs control mode switching only when the shift position of the shift mechanism 9 is at the neutral position. The control mode is switched in response to an operation on the station changeover switch 47S. Therefore, an operation input from the station changeover switch 47S is validated only when the shift position of the shift mechanism 9 is at the neutral position. The mode switching control unit 35S invalidates an operation input of the station changeover switch 47S when the shift position is at the forward drive position or the reverse drive position.

The function as the inter-station phase shift determination unit 36M or 36S is to determine whether phase shift $\Delta\theta=|\Delta\theta_M-\Delta\theta_S|$ between the steering angle $\theta_M$ of the main steering mechanism 5M and the steering angle $\theta_S$ of the sub steering mechanism 5S is not more than a predetermined threshold $\epsilon_1$ ($\geqq 0$). In other words, it is determined whether a phase shift has substantially occurred between the steering angles $\theta_M$ and $\theta_S$ of the main station 41M and the sub station 41S. The inter-station phase shift determination unit 36M or 36S determines whether a phase shift has occurred between steering angles $\theta_M$ and $\theta_S$ when the station changeover switch 47M or 47S is operated.

The function as the switching delay unit 37M or 37S is to delay mode switching of the mode switching control unit 35M or 35S when it is determined that the phases of the steering angles $\theta_M$ and $\theta_S$ of the main station 41M and the sub station 41S are greatly different. The switching delay unit 37M or 37S delays control mode switching until the steering angle phase shift between the main steering mechanism 5M and the sub steering mechanism 5S is eliminated (until the phase shift becomes not more than the threshold $\epsilon_1$).

The function as the notification control unit 34M or 34S includes a function of indicating that the start of turning control is being delayed by the turning control delay unit 33M or 33S by the indicator 7M or 7S. Further, the function as the notification control unit 34M or 34S includes a function of displaying a direction of phase shift between the steering angle $\theta_M$ or $\theta_S$ of the steering mechanism 5M or 5S and a turning angle δ of the turning mechanism 4, or a direction in which the steering mechanism 5M or 5S should be operated for eliminating the phase shift on the display 8M or 8S. Also, the function as the notification control unit 34M or 34S includes a function of indicating that switching of the control mode is being delayed by the switching delay unit 37M or 37S by the indicator 7M or 7S. Further, the function as the notification control unit 34M or 34S includes a function of displaying a direction of phase shift between steering angles of the main steering mechanism 5M and the sub steering mechanism 5S, or a direction in which the steering mechanism 5M or 5S should be operated for eliminating the phase shift on the display 8M or 8S.

Operations when the system is started by the start/stop switch 46M or 46S (when the power supply is turned on) are substantially the same as in the first preferred embodiment described above.

In detail, when the power supply is turned on by the start/stop switch 46M of the main key switch device 45M, both of the main controller 6M and the sub controller 6S start, and the power supply of the outboard motor 3 is also turned on. A control mode when the system is started by an operation of the main key switch device 45M is the main station mode. Therefore, turning control by the main controller 6M is enabled. However, before turning control by the main controller 6M is enabled, the main controller 6M determines whether phases of the steering angle $\theta_M$ of the main steering mechanism 5M and the turning angle $\delta$ of the turning mechanism 4 are shifted relative to each other. When they are not shifted relative to each other, the main controller 6M starts turning control immediately. However, when a significant phase shift occurs, the main controller 6M delays the start of turning control until the phase shift is eliminated by an operation of the main steering mechanism 5M. During this time, the main indicator 7M is driven to flash, and information on a direction of the phase shift is displayed on the main display 8M.

On the other hand, the power supply is turned on by the start/stop switch 46S of the sub key switch device 45S, both of the main controller 6M and the sub controller 6S are started, and the power supply of the outboard motor 3 is also turned on. The control mode when the system is started by an operation of the sub key switch device 45S is the sub station mode. Therefore, turning control by the sub controller 6S is enabled. However, before turning control by the sub controller 6S is enabled, the sub controller 6S determines whether phases of the steering angle $\theta_S$ of the sub steering mechanism 5S and the turning angle $\delta$ of the turning mechanism 4 are shifted relative each other. When they are not shifted relative to each other, the sub controller 6S starts turning control immediately. However, when significant phase shift occurs, the sub controller 6S delays the start of turning control until the phase shift is eliminated by an operation of the sub steering mechanism 5S. During this time, the sub indicator 7S is driven to flash, and information on a direction of the phase shift is displayed on the sub display 8S.

Figure 8:
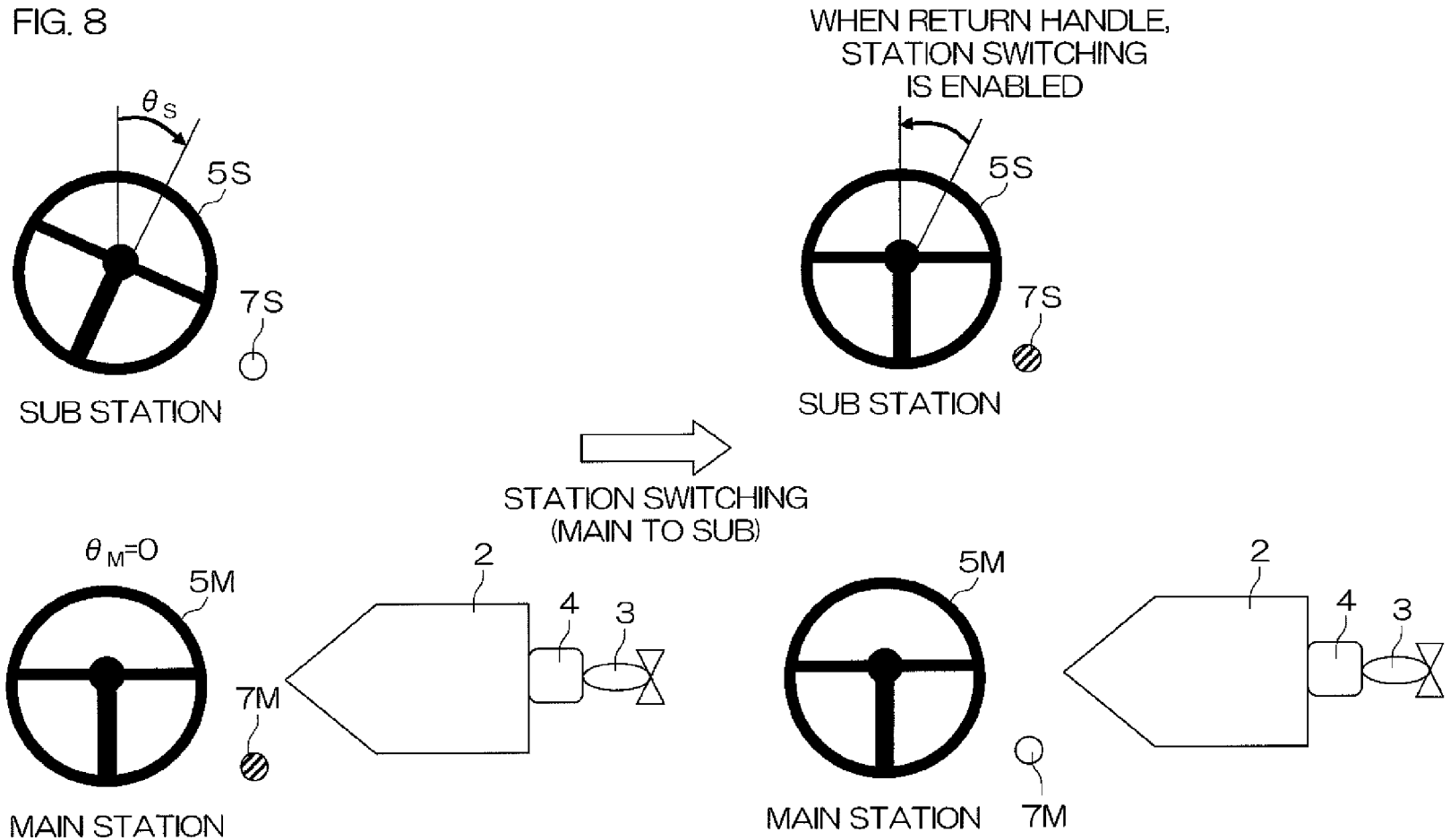
FIG. 8 is an explanatory view illustrating operations when switching between a main station mode and a sub station mode.

FIG. 8 is an explanatory view illustrating operations when switching between the main station mode and the sub station mode. In the main station mode, turning control is performed such that the turning angle $\delta$ of the turning mechanism 4 corresponds to the steering angle $\theta_M$ of the main steering mechanism 5M. In this case, the sub controller 6S does not perform turning control, so that the steering angle $\theta_S$ of the sub steering mechanism 5S and the turning angle $\delta$ of the turning mechanism 4 do not correspond to each other. Therefore, the steering angle $\theta_M$ of the main steering mechanism 5M and the steering angle $\theta_S$ of the sub steering mechanism 5S are not equal to each other ($\theta_M \neq \theta_S$), and a phase shift occurs between these angles. For example, even when the main steering mechanism 5M is at the neutral position and the steering angle $\theta_M=0$, the sub steering mechanism 5S deviates from the neutral position and the steering angle $\theta_S \neq 0$, generally. The steering angle ranges of the steering mechanisms 5M and 5S are, for example, mechanically limited. Detailed steering angle ranges are, for example, about 1260 degrees to each of the left and right, respectively. Therefore, if the phase shift remains, either the left or right steering angle range and turning angle range become narrower than normal.

When the station changeover switch 47S is operated in the sub key switch device 45S, the sub controller 6S performs processing for control mode switching. At this time, the sub controller 6S acquires information on the steering angle $\theta_M$ of the main steering mechanism 5M from the main controller 6M. Then, the sub controller 6S obtains steering angle phase shift between the main steering mechanism 5M and the sub steering mechanism 5S. When this phase shift exceeds a predetermined threshold $\epsilon_1$, the sub controller 6S delays control mode switching. In detail, the sub controller 6S delays control mode switching until the phase shift between the steering angles $\theta_M$ and $\theta_S$ is eliminated by an operation of the sub steering mechanism 5S (or the main steering mechanism 5M) by a steering operator. When the phase shift is eliminated, the sub controller 6S switches its own control mode to the sub station mode. Meanwhile, the sub controller 6S transmits a control mode switching signal to the main controller 6M. The main controller 6M receives the control mode switching signal and changes its own control mode to the sub station mode. Therefore, the main controller 6M disables its own turning control, and does not control the turning motor 24. Meanwhile, turning control of the sub controller 6S is enabled. In other words, the sub controller 6S sets a target turning angle $\delta^*$ corresponding to a steering angle $\theta_S$ detected by the sub steering angle sensor 51S and supplies it to the outboard motor ECU 50.

Also, at the time of control mode switching, when a steering angle phase shift occurs between the main steering mechanism 5M and the sub steering mechanism 5S, for example, the sub controller 6S flashes the sub indicator 7S. Accordingly, a steering operator is notified of station switching being delayed due to a phase shift.

Also, the sub controller 6S displays information on a direction of phase shift on the sub display 8S. This information may be a direction of phase shift. In this case, a steering operator can eliminate the phase shift by rotating the sub steering mechanism 5S in a direction opposite to the displayed direction. Also, the information may be a direction in which the sub steering mechanism 5S should be operated for eliminating the phase shift. In this case, the steering operator can eliminate the phase shift by rotating the sub steering mechanism 5S in the displayed direction.

When the steering angle phase shift between the main steering mechanism 5M and the sub steering mechanism 5S is eliminated, the sub controller 6S switches the sub indicator 7S from flashing indication to continuous lighting. Accordingly, the steering operator is notified of a state in which steering in the sub station 41S is enabled, that is, the outboard motor 3 can be turned by an operation of the sub steering mechanism 5S.

Operations when switching from the sub station mode to the main station mode are also the same. That is, in the description given above, the operation on the main station 41M side and the operation on the sub station 41S side are replaced with each other.

Figure 9A:
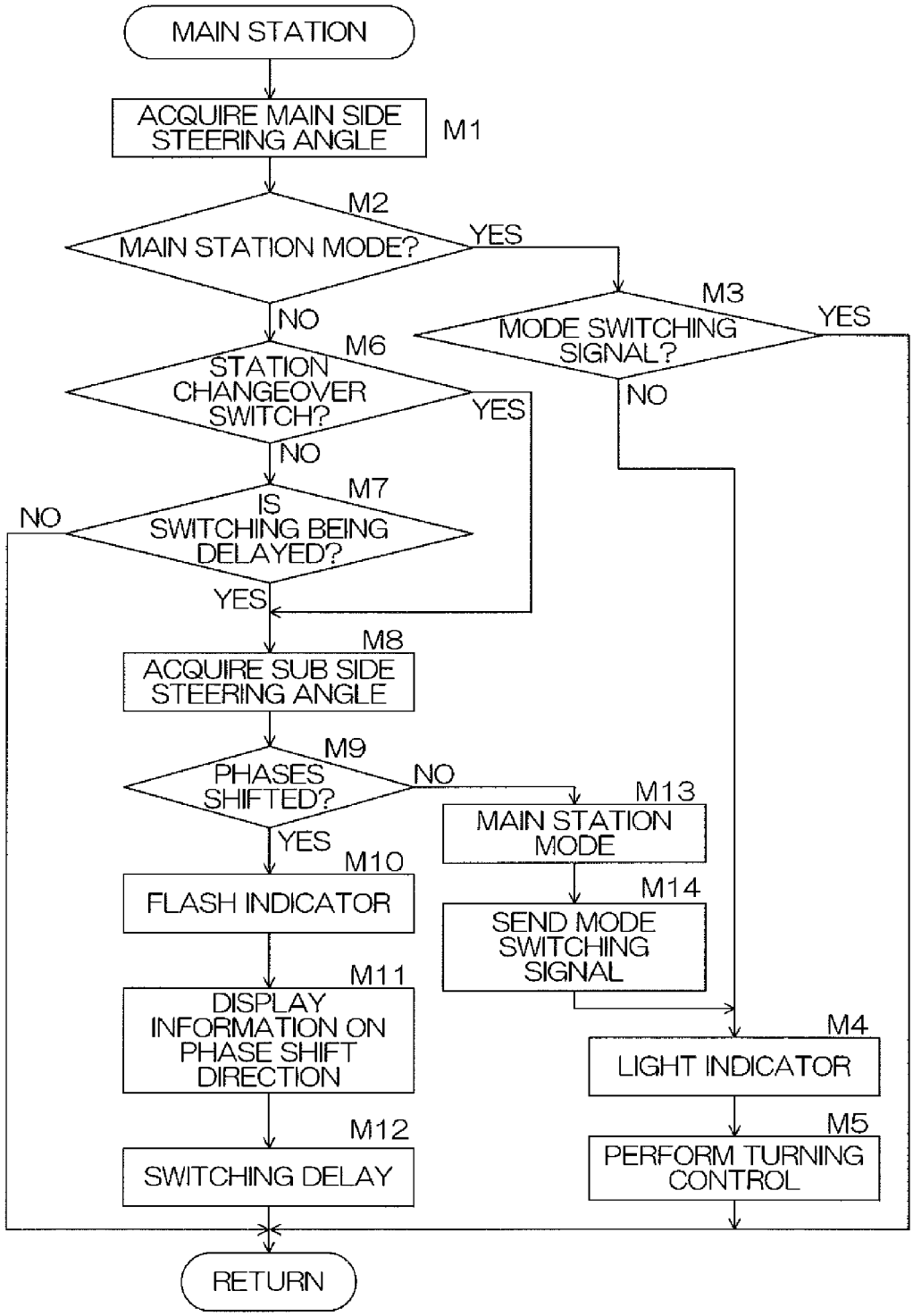
FIG. 9A is a flowchart for describing operations concerning station switching, showing operations in the main station.
Figure 9B:
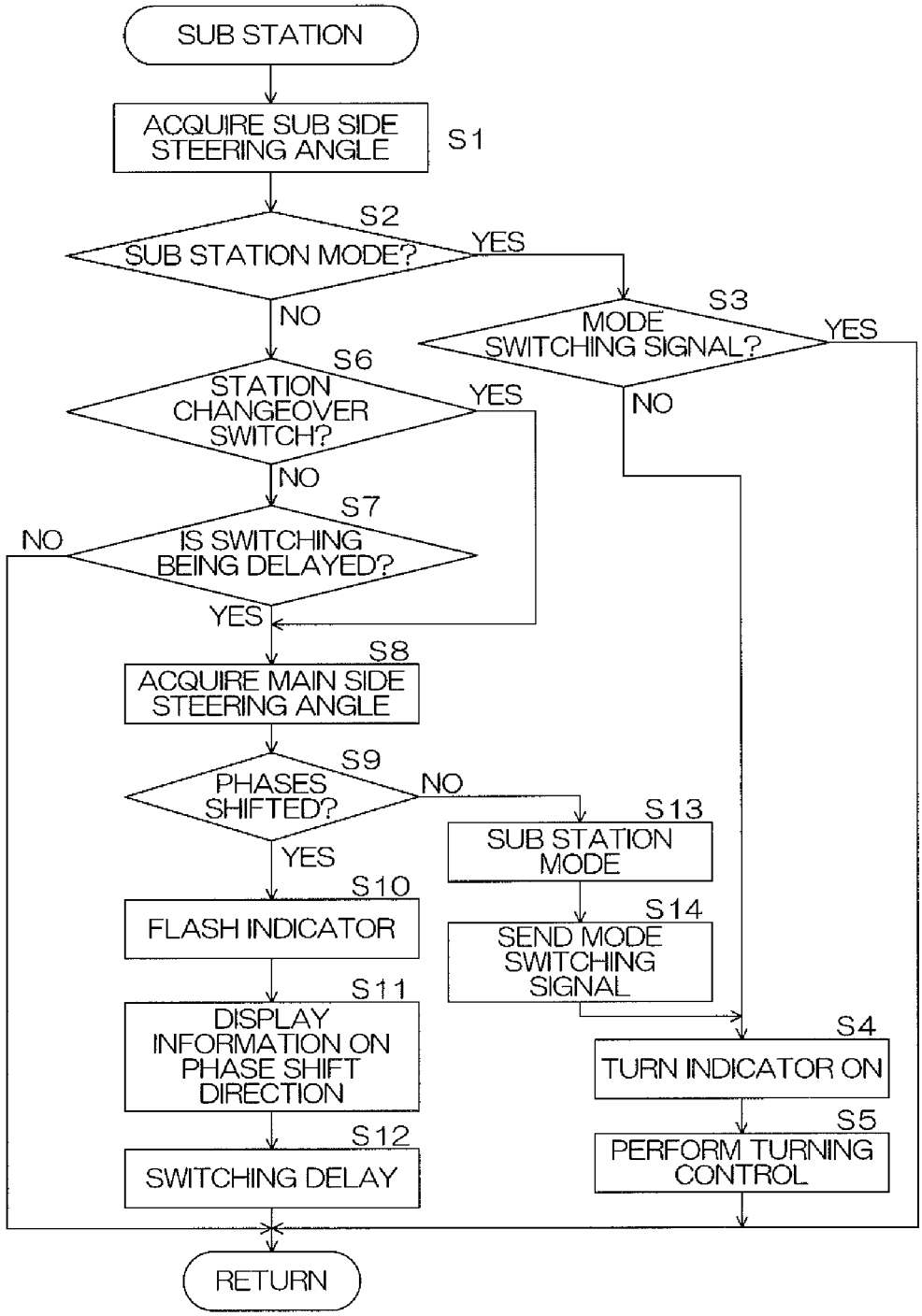
FIG. 9B is a flowchart for describing operations concerning station switching, showing operations in the sub station.

FIG. 9A and FIG. 9B are flowcharts for describing operations concerning control mode switching (station switching). FIG. 9A shows operations in the main station 41M, and FIG. 9B shows operations in the sub station 41S.

First, with reference to FIG. 9A, operations to be repeatedly performed in the main station 41M in each predetermined control period will be described. The main controller 6M acquires a steering angle $\theta_M$ detected by the main steering angle sensor 51M (Step M1). Then, the main controller 6M determines whether the current control mode is the main station mode (Step M2). When the current control mode is the main station mode (Step M2: YES), the main controller 6M further determines whether it has received a mode switching signal for commanding switching to the sub station mode from the sub controller 6S (Step M3). When the main controller does not receive a mode switching signal (Step M3: NO), the main controller 6M lights (e.g., continuously lights) the main indicator 7M (Step M4), and notifies the steering operator that steering by the main steering mechanism 5M is enabled. Further, the main controller 6M performs turning control (Step M5: function as the turning control unit 31M). Specifically, the main controller 6M sets a target turning angle $\delta^*$ based on a steering angle $\theta_M$ detected by the main steering angle sensor 51M. Further, the main controller 6M gives the set target turning angle δ* to the outboard motor ECU 50. The outboard motor ECU 50 feed-back controls the turning motor 24 such that the turning angle δdetected by the turning angle sensor 30 becomes equal to the target turning angle δ*.

As described above, immediately after the main station 41 is started, phases of the steering angle $\theta_M$ of the main steering mechanism 5M and the turning angle δ of the turning mechanism 4 may be shifted relative to each other. In this case, even in the main station mode, the main indicator 7M is controlled to flash.

On the other hand, in the sub station mode (Step M2: NO), the main controller 6M determines whether the station changeover switch 47M of the main key switch device 45M has been operated (Step M6). When the station changeover switch 47M is not operated (Step M6: NO), the main controller 6M determines whether switching from the sub station mode to the main station mode is being delayed (Step M7). When switching is not being delayed (Step M7: NO), subsequent processes are not performed in the present control period.

When the station changeover switch 47M is operated (Step M6: YES) and when it is determined that switching is being delayed (Step M7: YES), the main controller 6M acquires a steering angle $\theta_S$ detected by the sub steering angle sensor 51S from the sub controller 6S via the communication line 48 (Step M8). By using the steering angle $\theta_S$ on the sub station 41S side, the main controller 6M determines whether phases of the steering angle $\theta_M$ of the main steering mechanism 5M and the steering angle $\theta_S$ of the sub steering mechanism 5S are shifted relative to each other (Step M9: function as the inter-station phase shift determination unit 36M). In detail, the main controller 6M obtains a phase shift $\Delta\theta=|\theta_M-\theta_S|$ (difference between steering angles), and when this phase shift Δθ exceeds the threshold $\epsilon_1$, the main controller determines that a phase shift has occurred, and otherwise, determines that a phase shift has not occurred.

When it is determined that phase shift has not occurred (Step M9: NO), the main controller 6M switches the control mode to the main station mode (Step M13: function as the mode switching control unit 35M). Further, the main controller 6M sends a mode switching signal for commanding switching of the control mode to the main station mode to the sub controller 6S via the communication line 48 (Step M14). Thereafter, the process of the main controller 6M moves to step M4, and the main indicator 7M is lighted (Step M4) and turning control is performed (Step M5).

On the other hand, when it is determined that the phases of the steering angles are shifted relative to each other (Step M9: YES), the main controller 6M drives and flashes the main indicator 7M (Step M10: function as the notification control unit 34M) and displays information on a direction of phase shift on the main display 8M. (Step M11: function as the notification control unit 34M). Then, the main controller 6M delays switching to the main station mode (Step M12: function as the switching delay unit 37M), and writes information showing that the switching is being delayed on a memory (not shown). This information is used for the determination of Step M7.

In the period immediately after the station changeover switch 47M is operated, the deviation between the steering angle $\theta_M$ of the main steering mechanism 5M and the steering angle $\theta_S$ of the sub steering mechanism 5S is great. Therefore, the main indicator 7M is flashed, and on the main display 8M, information on the direction of the phase shift is displayed. Therefore, the steering operator turns the main steering mechanism 5M based on the indication on the main display 8M. When the phase shift between the steering angles $\theta_M$ and $\theta_S$ is thus eliminated, the main indicator 7M is continuously lighted, and turning control of the main controller 6M is started. Thus, turning control is delayed until the phase shift is thus eliminated by an operation of the main steering mechanism 5M by the steering operator.

Next, operations to be repeatedly performed in the sub station 41S in each predetermined control period will be described with reference to FIG. 9B. The sub controller 6S acquires a steering angle $\theta_S$ detected by the sub steering angle sensor 51S (Step S1). Then, the sub controller 6S determines whether the current control mode is the sub station mode (Step S2). When the control mode is the sub station mode (Step S2: YES), the sub controller 6S further determines whether it has received a mode switching signal for commanding switching to the main station mode from the main controller 6M (Step S3). When it does not receive a mode switching signal (Step S3: NO), the sub controller 6S lights (continuously lights) the sub indicator 7S (Step S4) and notifies a steering operator that steering by the sub steering mechanism 5S is enabled. Further, the sub controller 6S performs turning control (Step S5: function as the turning control unit 31S). Specifically, the sub controller 6S sets a target turning angle δ* based on the steering angle $\theta_S$ detected by the sub steering angle sensor 51S. Further, the sub controller 6S gives the set target turning angle δ* to the outboard motor ECU 50. The outboard motor ECU 50 feed-back controls the turning motor 24 such that the turning angle δ detected by the turning angle sensor 30 becomes equal to the target turning angle δ*.

As described above, immediately after the sub station 41S is started, a phase shift between the steering angle $\theta_S$ of the sub steering mechanism 5S and the turning angle δ of the turning mechanism 4 may occur. In this case, even in the sub station mode, the sub indicator 7S is controlled to flash.

On the other hand, when the control mode is the main station mode (Step S2: NO), the sub controller 6S determines whether the station changeover switch 47S of the sub key switch device 45S has been operated (Step S6). When the station changeover switch 47S is not operated (Step S6: NO), the sub controller 6S further determines whether switching from the main station mode to the sub station mode is being delayed (Step S7). When it is not being delayed (Step S7: NO), subsequent processes are not performed in the present control period.

When the station changeover switch 47S is operated (Step S6: YES) and when it is determined that switching is being delayed (Step S7: YES), the sub controller 6S acquires a steering angle $\theta_M$ detected by the main steering angle sensor 51M from the main controller 6M via the communication line 48 (Step S8). By using this steering angle $\theta_M$ on the main station 41M side, the sub controller 6S determines whether phase shift between the steering angle $\theta_S$ of the sub steering mechanism 5S and the steering angle $\theta_M$ of the main steering mechanism 5M has occurred (Step S9: function as the inter-station phase shift determination unit 36S). In detail, the sub controller 6S obtains a phase shift $\Delta\theta=|\theta_M-\theta_S|$ (difference between steering angles), and when this phase shift Δθ exceeds the threshold $\epsilon_1$, the sub controller determines that a phase shift has occurred, and otherwise, determines that phase shift has not occurred.

When it is determined that a phase shift has not occurred (Step S9: NO), the sub controller 6S switches the control mode to the sub station mode (Step S13, function as the mode switching control unit 35S). Further, the sub controller 6S sends a mode switching signal for commanding switching of the control mode to the sub station mode to the main controller 6M via the communication line 48 (Step S14). Thereafter, the process of the sub controller 6S changes to Step S4, and the sub indicator 7S is turned on (Step S4) and turning control is performed (Step S5).

On the other hand, when it is determined that phase shift between the steering angles has occurred (Step S9: YES), the sub controller 6S drives and flashes the sub indicator 7S (Step S10: function as the notification control unit 34S), and displays information on a direction of the phase shift on the sub display 8S (Step S11: function as the notification control unit 34S). Then, the sub controller 6S delays switching to the sub station mode (Step S12: function as the switching delay unit 37S), and writes information showing that switching is being delayed on the memory (not shown). This information is used for the determination of Step S7.

In the period immediately after the station changeover switch 47S is operated, the deviation between the steering angle $\theta_S$ of the sub steering mechanism 5S and the steering angle $\theta_M$ of the main steering mechanism 5M is great. Therefore, the sub indicator 7S is flashed, and on the sub display 8S, information on a direction of the phase shift is displayed. Therefore, the steering operator turns the sub steering mechanism 5S based on the indication on the sub display 8S. When the phase shift between the steering angles $\theta_M$ and $\theta_S$ is accordingly eliminated, the sub indicator 7S is continuously lighted, and turning control by the sub controller 6S is started. Thus, turning control is delayed until phase shift is eliminated by an operation of the sub steering mechanism 5S by a steering operator.

In addition, the main controller 6M determines whether the shift position of the shift mechanism 9 is at the neutral position when the mode changeover switch 47M is operated although this is not shown in FIG. 9A and FIG. 9B. Then, when the shift position is at the neutral position, an operation input of the mode changeover switch 47M is validated. However, when the shift position is at a position other than the neutral position, an operation input of the mode changeover switch 47M is invalidated. Similarly, the sub controller 6S determines whether the shift position of the shift mechanism 9 is at the neutral position when the mode changeover switch 47S is operated. When the shift position is at the neutral position, an operation input of the mode changeover switch 47S is validated. However, when the shift position is at a position other than the neutral position, an operation input of the mode changeover switch 47S is invalidated.

Thus, according to the present preferred embodiment, when the steering station is switched according to operations of the station changeover switches 47M and 47S, switching of the steering station is delayed until a phase shift between steering angles of the stations 41M and 41S is eliminated by an operation of the steering mechanism by a steering operator. Accordingly, station switching can be enabled in a state in which a phase shift between the steering stations is eliminated. Steering in the steering station after being switched can be performed without problems.

An operation such as forcible turning of the steering mechanism by an actuator for phase shift elimination is not performed, so that the experience of the steering operator can be greatly improved. Further, in the present preferred embodiment, the steering operator is notified that station switching is being delayed due to phase shift by the indicator 7M or 7S, so that the operator is informed of the delay of station switching to further improve the experience of the operator. Further, information on a direction of the phase shift is displayed on the display 8M or 8S, so that the steering operator can perform a steering operation necessary for eliminating phase shift without fail. Accordingly, phase shift can be quickly eliminated, and steering in the steering station after being switched can be enabled accordingly.

Although two preferred embodiments of the present invention are described above, the present invention can be further carried out in many other preferred embodiments within the scope of the present invention. For example, in the preferred embodiments described above, in addition to the indicators 7, 7M, and 7S which indicate that turning control or station switching is being delayed, displays 8, 8M, and 8S which display information on a direction of phase shift are preferably provided. However, the displays 8, 8M, and 8S may be omitted. Instead of the indicators 7, 7M, and 7S, a sound production unit which produces a notification sound, such as a buzzer, may be provided. Further, in the second preferred embodiment described above, the indicators 7, 7M, and 7S are preferably used for notifying delay of turning control and delay of station switching. However, different notification units may be used for providing notification of turning control delay and station switching delay, respectively.

In FIG. 1 and FIG. 3, an arrangement in which signals are preferably exchanged between the controller 6 and the turning mechanism 4 is shown. However, it is not always necessary that these directly exchange signals with each other. Specifically, as in the arrangement shown in FIG. 7, a detection value of the turning angle sensor 30 may be supplied to the controller 6 via the outboard motor ECU so that the turning motor 24 is controlled via the outboard motor ECU.

Further, in the second preferred embodiment described above, the main station 41M and the sub station 41S are preferably provided with the controllers 6M and 6S, respectively. This is merely an example, however. That is, one controller may be shared by the main station 41M and the sub station 41S, and by this one controller, steering in either of the steering stations may be validated, while invalidating steering in the other of the steering stations.

In the preferred embodiments described above, a single-outboard motor equipped arrangement including one outboard motor is described. However, the present invention is also applicable to a multiple-outboard motor equipped arrangement including two or more outboard motors on a marine vessel. Of course, the outboard motor is merely an example of a propulsion device, and the present invention is also applicable to a marine vessel including a propulsion device in other forms. A motor as a drive source for obtaining a propulsion force is not limited to an internal combustion, and may be an electric motor.

While preferred embodiments of the present invention have been described above, it is to be understood that variations and modifications will be apparent to those skilled in the art without departing the scope and spirit of the present invention. The scope of the present invention, therefore, is to be determined solely by the following claims.

The present application corresponds to Japanese Patent Application No. 2008-322973 filed in the Japan Patent Office on Dec. 18, 2008, and the entire disclosure of the application is incorporated herein by reference.

What is claimed is:

1. A marine vessel steering device comprising:

a turning mechanism;

an operation unit that is operated by an operator to turn the turning mechanism;

a steering angle detection unit to detect a steering angle of the operation unit;

a turning angle detection unit to detect a turning angle of the turning mechanism;

a turning control unit to control the turning mechanism according to a steering angle detected by the steering angle detection unit;

a phase shift determination unit to determine whether a phase of the steering angle detected by the steering angle detection unit and a phase of the turning angle detected by the turning angle detection unit are shifted relative to each other constituting a phase shift wherein a deviation exists between the phase of the steering angle and the phase of the turning angle; and a turning control delay unit to start control of the turning mechanism by the turning control unit after elimination of the phase shift by an operation of the operation unit when the phase shift determination unit determines that the phase of the steering angle and the phase of the turning angle are shifted relative to each other when starting the turning control unit, wherein the elimination of the phase shift results in the steering angle and the turning angle having the same phase.

2. The marine vessel steering device according to claim 1, further comprising a notification unit to provide notification that start of control of the turning mechanism is being delayed by the turning control delay unit.

3. The marine vessel steering device according to claim 1, further comprising an operation supporting information notification unit to provide notification to the operator of a phase shift direction or an operation direction for phase shift elimination.

4. A marine vessel steering device comprising:

a turning mechanism;

a first operation unit and a second operation unit that is operated by an operator to turn the turning mechanism;

a first steering angle detection unit to detect a first steering angle which is a steering angle of the first operation unit;

a second steering angle detection unit to detect a second steering angle which is a steering angle of the second operation unit;

a turning control unit including a first controlling state in which the turning control unit controls the turning mechanism according to a first steering angle detected by the first steering angle detection unit and a second controlling state in which the turning control unit controls the turning mechanism according to a second steering angle detected by the second steering angle detection unit;

a steering angle phase shift determination unit to determine whether a phase of the first steering angle detected by the first steering angle detection unit and a phase of the second steering angle detected by the second steering angle detection unit are shifted relative to each other constituting a phase shift wherein a deviation exists between the phase of the steering angle and the phase of the turning angle;

a control switching unit to switch the controlling state of the turning control unit between the first controlling state and the second controlling state; and a switching delay unit to enable switching of the controlling state after elimination of the phase shift by an operation of the first or second operation unit when the steering angle phase shift determination unit determines that the phase shift between the first and second steering angles has occurred when switching the control state by the control switching unit, wherein the elimination of the phase shift results in the first steering angle and the second steering angle having the same phase.

5. The marine vessel steering device according to claim 4, further comprising a notification unit to provide notification that switching of the controlling state is being delayed by the switching delay unit.

6. The marine vessel steering device according to claim 4, further comprising an operation supporting information notification unit to provide notification to the operator of a phase shift direction or an operation direction for phase shift elimination.

7. A marine vessel comprising:

a hull;

a turning mechanism attached to the hull;

an operation unit that is operated by an operator to turn the turning mechanism;

a steering angle detection unit to detect a steering angle of the operation unit;

a turning angle detection unit to detect a turning angle of the turning mechanism;

a turning control unit to control the turning mechanism according to a steering angle detected by the steering angle detection unit;

a phase shift determination unit to determine whether a phase of the steering angle detected by the steering angle detection unit and a phase of the turning angle detected by the turning angle detection unit are shifted relative to each other constituting a phase shift wherein a deviation exists between the phase of the steering angle and the phase of the turning angle; and a turning control delay unit to start control of the turning mechanism by the turning control unit after elimination of the phase shift by an operation of the operation unit when the phase shift determination unit determines that the phases of the steering angle and the turning angle are shifted relative to each other when starting the turning control unit, wherein the elimination of the phase shift results in the steering angle and the turning angle having the same phase.

8. The marine vessel according to claim 7, further comprising a notification unit to provide notification that start of control of the turning mechanism is being delayed by the turning control delay unit.

9. The marine vessel according to claim 7, further comprising an operation supporting information notification unit to provide notification to the operator of a phase shift direction or an operation direction for phase shift elimination.

10. A marine vessel comprising:

a hull;

a turning mechanism attached to the hull;

a first operation unit and a second operation unit that is operated by an operator to turn the turning mechanism;

a first steering angle detection unit to detect a first steering angle which is a steering angle of the first operation unit;

a second steering angle detection unit to detect a second steering angle which is a steering angle of the second operation unit;

a turning control unit including a first controlling state in which the turning control unit controls the turning mechanism according to a first steering angle detected by the first steering angle detection unit and a second controlling state in which the turning control unit controls the turning mechanism according to a second steering angle detected by the second steering angle detection unit;

a steering angle phase shift determination unit to determine whether a phase of the first steering angle detected by the first steering angle detection unit and a phase of the second steering angle detected by the second steering angle detection unit are shifted relative to each other constituting a phase shift wherein a deviation exists between the phase of the steering angle and the phase of the turning angle;

a control switching unit to switch the controlling state of the turning control unit between the first controlling state and the second controlling state; and a switching delay unit to enable switching of the controlling state after elimination of the phase shift by an operation of the first or second operation unit when the steering angle phase shift determination unit determines that the phase shift between the first and second steering angles has occurred when switching of the control state by the control switching unit, wherein the elimination of the phase shift results in the first steering angle and the second steering angle having the same phase.

11. The marine vessel according to claim 10, further comprising a notification unit to provide notification that switching of the controlling state is being delayed by the switching delay unit.

12. The marine vessel according to claim 10, further comprising an operation supporting information notification unit to provide notification to the operator of a phase shift direction or an operation direction for phase shift elimination.

* * * * *